US005701925A

United States Patent [19]

Mulligan et al.

[11] Patent Number: 5,701,925

[45] Date of Patent: Dec. 30, 1997

[54] SANITARY YARD HYDRANT

[75] Inventors: Shaun T. Mulligan, Lakewood; Robert J. Vandepas, Colorado Springs; James F. Shuler, Colorado Springs; Lawrence Almasy, Colorado Springs, all of Colo.

[73] Assignee: WCM Industries, Inc., Colorado Springs, Colo.

[21] Appl. No.: 529,591

[22] Filed: Sep. 18, 1995

[51] Int. Cl.[6] ..... F16K 11/20

[52] U.S. Cl. ..... 137/119.05; 137/282; 137/302; 137/467

[58] Field of Search ..... 137/119.05, 282, 137/302, 467

[56] References Cited

U.S. PATENT DOCUMENTS

| | | | |
|---|---|---|---|
| 2,580,199 | 12/1951 | Schmid | 137/301 |
| 2,598,488 | 5/1952 | Bart | 137/282 |
| 2,605,781 | 8/1952 | Schmid et al. | 137/301 |
| 2,664,096 | 12/1953 | Murdock et al. | 131/301 |
| 3,017,896 | 11/1962 | Papacek | 137/282 |
| 3,029,603 | 7/1962 | Ackroyd | 137/302 |
| 3,070,116 | 12/1962 | Noland et al. | 137/302 |
| 3,416,555 | 12/1968 | Chapou | 137/467 |
| 3,424,189 | 1/1969 | Woodford | 137/302 |
| 3,885,585 | 5/1975 | Carpentier | 137/282 |
| 4,109,671 | 8/1978 | Hughes et al.1 | 137/282 |
| 4,112,966 | 9/1978 | Carlson | 137/282 |
| 4,178,956 | 12/1979 | Fillman | 137/302 |
| 4,503,877 | 3/1985 | Ward et al. | 137/467 |
| 4,653,521 | 3/1987 | Fillman et al. | 137/301 |
| 4,653,522 | 3/1987 | Fillman et al. | 137/301 |
| 4,854,339 | 8/1989 | Hoeptner, III | 137/301 |
| 5,033,500 | 7/1991 | Hoeptner, III | 137/301 |
| 5,246,028 | 9/1993 | Vandepas | 137/282 |

*Primary Examiner*—Stephen M. Hepperle

*Attorney, Agent, or Firm*—Zarley, McKee, Thomte, Voorhess, & Sease

[57] ABSTRACT

A yard hydrant of the venturi check valve-fluid reservoir type has a manually operable flow diverter valve which will provide full fluid flow through the hydrant to effectively siphon residual fluid from the reservoir without removal of hoses, backflow preventers or the like from the nozzle of the hydrant. The flow diverter valve is located upstream of the fluid discharge nozzle of the hydrant. A tube connects the venturi check valve with the extreme bottom of the reservoir so that all the residual fluid in the reservoir can be removed therefrom.

13 Claims, 4 Drawing Sheets

SANITARY YARD HYDRANT

BACKGROUND OF THE INVENTION

This invention is an improvement over the invention disclosed in U.S. Pat. No. 5,246,028 which disclosed a sanitary yard hydrant that had a fluid reservoir which collected residual fluid from the upper part of the hydrant when the hydrant was shut off. A venturi check valve in the bottom of the hydrant structure was connected to the reservoir and the fluid inlet conduit to permit the residual fluid in the reservoir to be siphoned therefrom into the inlet conduit when fluid under pressure was flowing therethrough.

However, if a hose, a backflow preventer, or any other nozzle attachment was placed on the hydrant, and which decreased the velocity of the supply fluid, the venturi check valve would not function to remove water from the reservoir. To overcome the problem, the hose, backflow preventer, or the like would have to be removed from the nozzle so that full fluid flow could be resumed so that residual fluid in the reservoir could be purged.

It is therefore a principal object of this invention to provide a yard hydrant having a venturi check valve-reservoir system which has an alternative fluid diverter discharge so that full fluid flow through the hydrant to purge the reservoir can be achieved without removing the hose, backflow preventer, or the like from the hydrant nozzle.

A further object of this invention is to provide a yard hydrant having a venturi check valve-reservoir system which can completely purge the residual fluid from the reservoir to avoid leaving a quantity of fluid therein which may become stagnant.

These and other objects will be apparent to those skilled in the art.

SUMMARY OF THE INVENTION

A yard hydrant of the venturi check valve-fluid reservoir type (See U.S. Pat. No. 5,246,028) has a manually operable flow diverter valve which will provide full fluid flow through the hydrant to effectively siphon residual fluid from the reservoir without removal of hoses, backflow preventers or the like from the nozzle of the hydrant. The flow diverter valve is located upstream of the fluid discharge nozzle of the hydrant.

A tube connects the venturi check valve with the extreme bottom of the reservoir so that all the residual fluid in the reservoir can be removed therefrom.

BRIEF DESCRIPTION OF TEE DRAWINGS

DESCRIPTION OF THE PREFERRED EMBODIMENT

Figure 1:
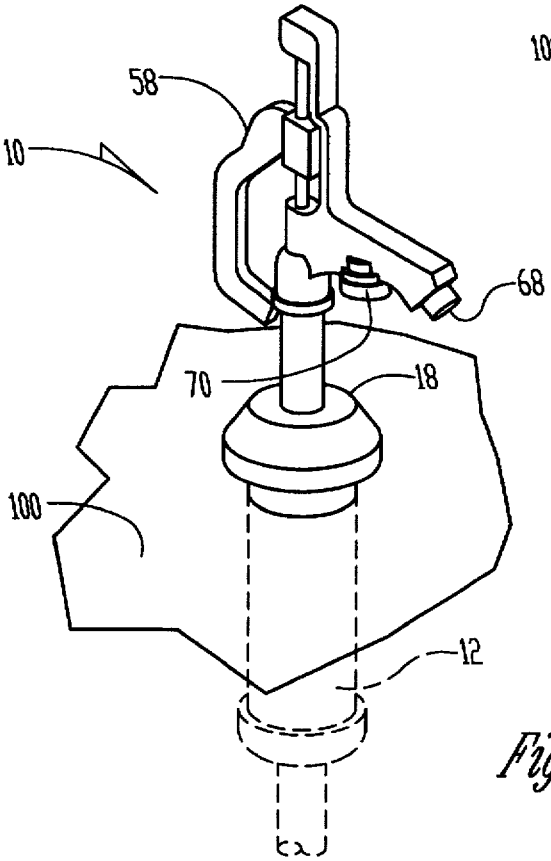
FIG. 1 is a perspective view of the hydrant of this invention.

The structure shown in the drawings is essentially the same as that disclosed in U.S. Pat. No. 5,246,028 except for a flow diverter element in the head casting of the hydrant, and except for a tube which connects the venturi check valve with the bottom of the fluid reservoir. However, to show the relationship of these two new novel components to the hydrant of this invention, the conventional portions of the hydrant will be described in some detail.

The hydrant 10 has a vertical tube 12 (FIG. 2) which has an internal fluid reservoir 13. Tube 12 has an upper end 14 and a lower end 16. A cap 18 covers the upper end 14 of tube 12 and has a vent 20 therein so that the fluid reservoir 13 can be purged of residual water at times as will be described hereafter. The lower end 16 of the tube is enclosed by a lower end cap 22 having a bottom 23. An opening 24 in the end cap 22 is adapted to be secured to a source of fluid under pressure (not shown).

Figure 2:
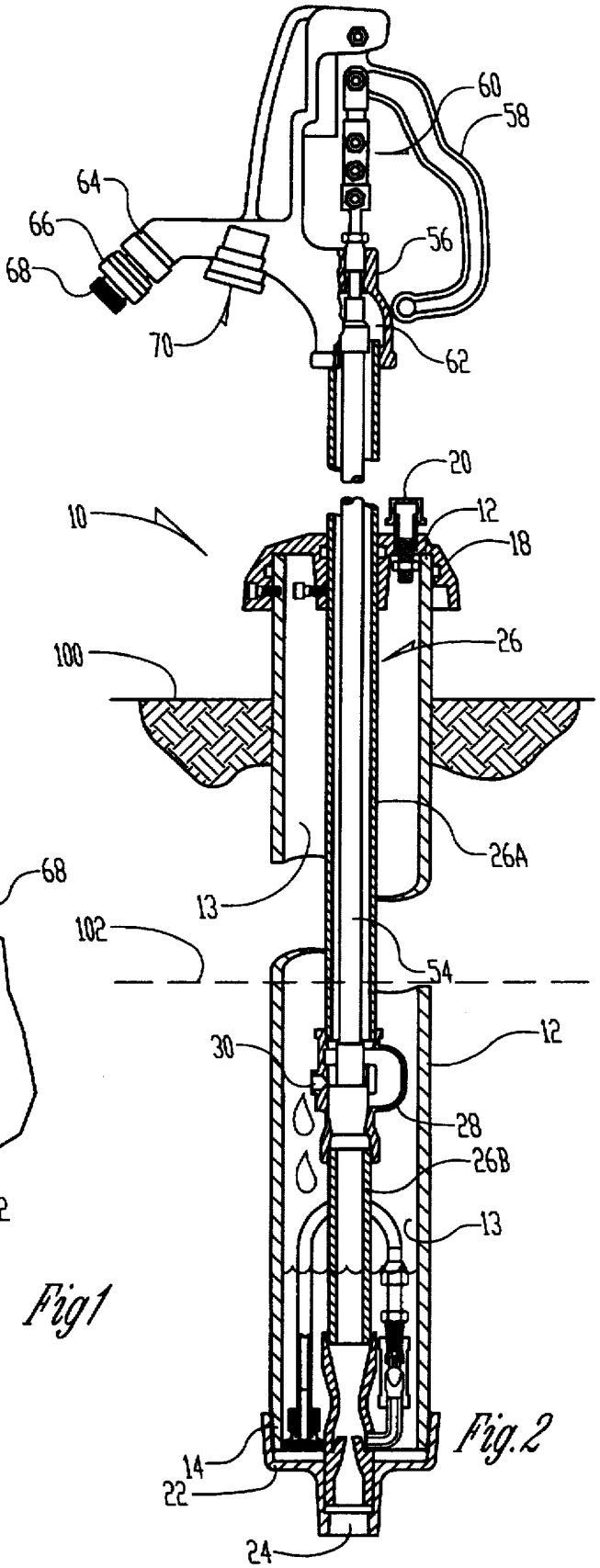
FIG. 2 is an enlarged scale vertical sectional view thereof.

A vertical pipe 26 comprised of an upper pipe 26A and a lower pipe 26B is best shown in FIG. 2. A control valve 28 is secured between the lower end of upper pipe 26A and the upper end of lower pipe 26B. Control valve 28 has a conventional drain hole 30 which is adapted to allow any water above the control valve 28 to drain into the fluid reservoir 13 when the control valve is closed.

Figure 3:
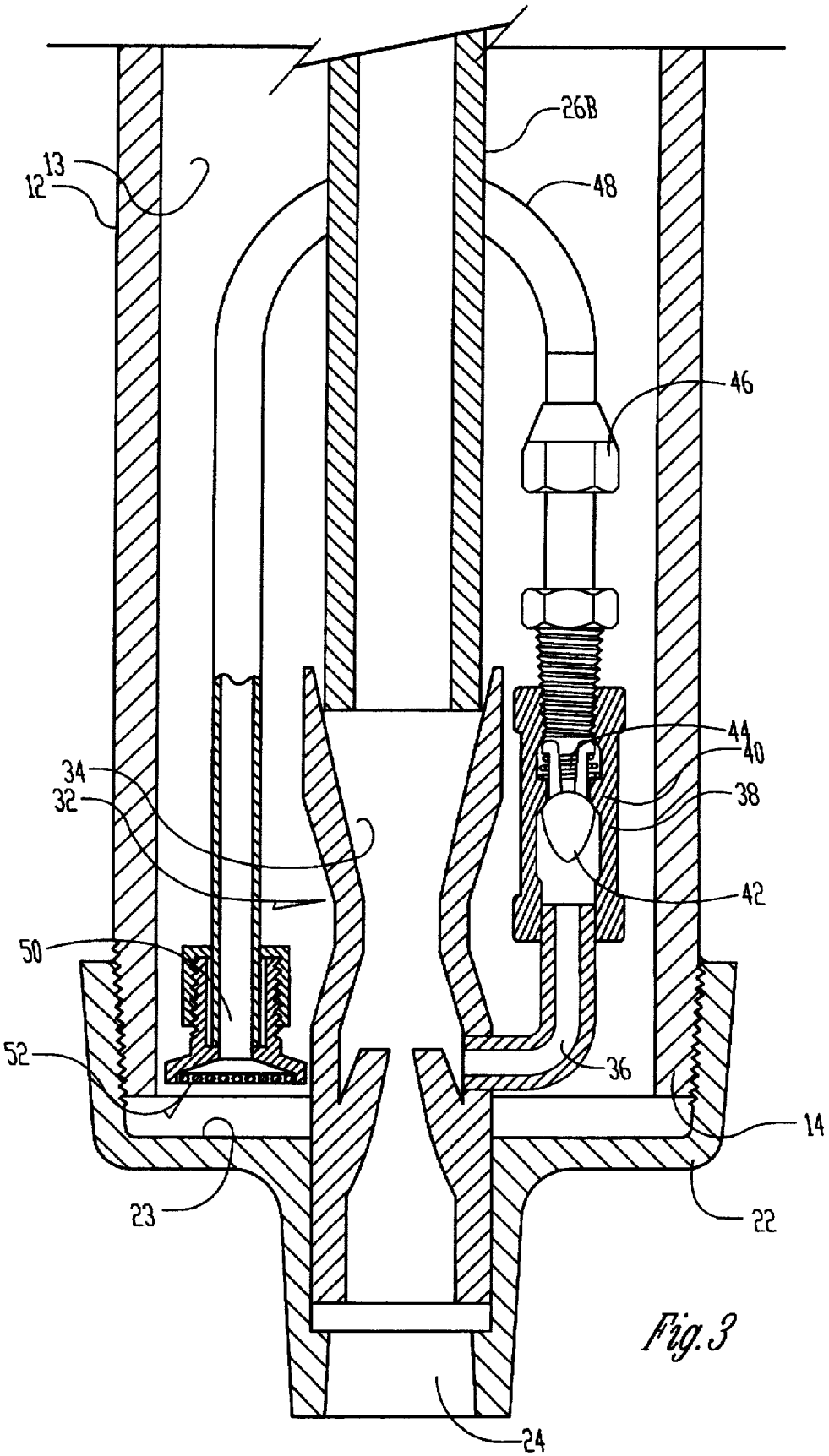
FIG. 3 is an enlarged scale sectional view of the bottom portion of the structure shown in FIG. 2.

A venturi check valve assembly 32 is best shown in FIG. 3. The venturi check valve assembly 32 includes a venturi conduit 34 to which is connected a venturi passage 36. A venturi check valve 38 is mounted on one end of the passage 36 and includes a valve seat 40. A valve plunger 42 which is adapted to engage valve seat 40 at times is urged into engagement with the valve seat 40 by means of spring 44. A connector 46 connects the venturi check valve 38 to the upper end of tube 48. The lower end 50 of tube 48 is open and extends to a level closely adjacent the bottom 23 of the fluid reservoir 13. A screen assembly 52 is mounted on the lower end 50 of tube 48.

An elongated operating rod 54 extends upwardly from control valve 28 into the hydrant head casting 56 (FIG. 2). A conventional hydrant handle 58 is connected to the operating rod 54 by linkage 60. A fluid conduit 62 is located in the head casting 56 and terminates in a conventional nozzle discharge end 64. A conventional backflow preventer 66 is mounted on the end 64 and can terminate in a conventional hose bib 68.

Except for the tube 48 and screen assembly 52 on the lower end thereof as described above, the foregoing structure is essentially identical to that disclosed in U.S. Pat. No. 5,246,028.

A flow diverter element 70 (FIGS. 7 and 8) is threadably secured within a threaded aperture 72 in fluid conduit 62 of head casting 56. The flow diverter element 70 is a conventional Delta Faucet bathtub spout diverter. Its normal use is to divert water from the tub spout to the shower head. The flow diverter element 70 comprises a hollow fitting 74 which has a central fluid flow way 76. The fitting 74 has a hollow center hub 78. The side walls of the diverter element 70 have a rectangular notch 80 formed therein. A compression spring 82 embraces the center of 78 and rests at the bottom of notch 80 as best shown in FIG. 6.

A slide control element 84 slidably embraces the exterior wall of hollow fitting 74 by means of side walls 86 which slidably embrace the outer walls of the diverter element. Slide control element 84 has a center post 88 that is slidably inserted through the center hub 78 of fitting 74. The inner end of center post 88 has a seal cap 92 secured thereto by means of screw 94. A peripheral O-ring 96 extends around seal cap 92 and is adapted to seal against valve seat 98 appearing at the upper peripheral edge of hollow fitting 74 (FIG. 6).

Figure 4:
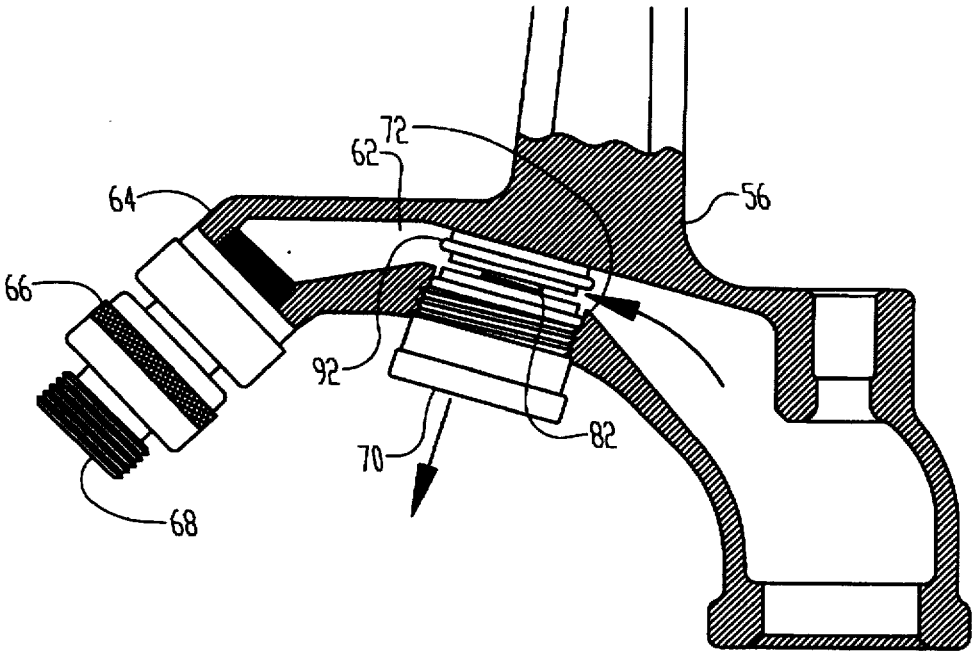
FIG. 4 is an enlarged scale sectional view of the head casting of the hydrant showing the flow diverter element in an open position.
Figure 5:
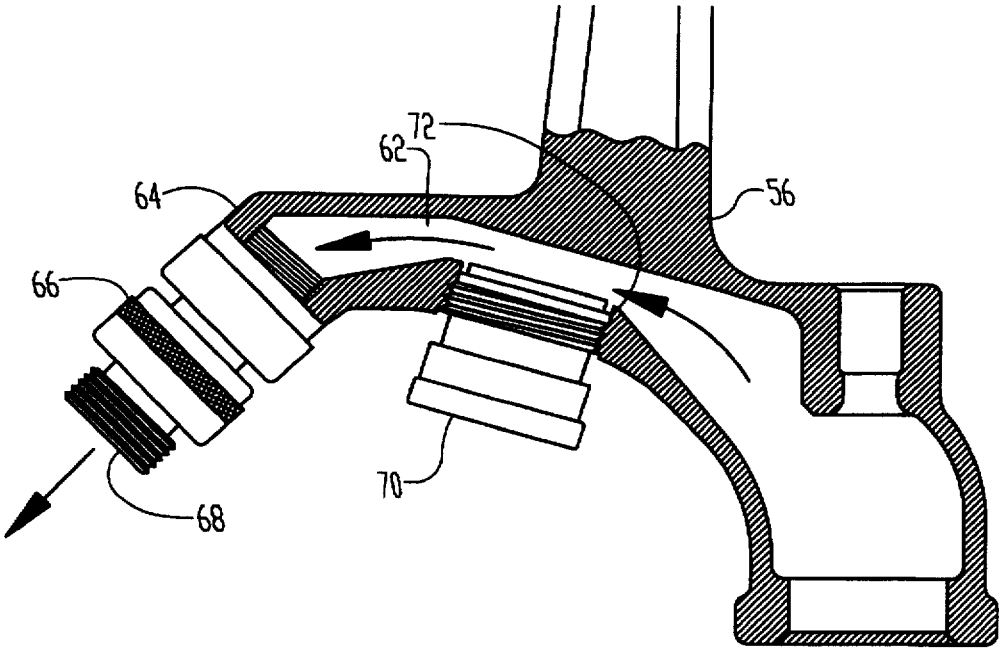
FIG. 5 is a sectional view similar to that of FIG. 4 but showing the flow diverter element in a closed position.
Figure 6:
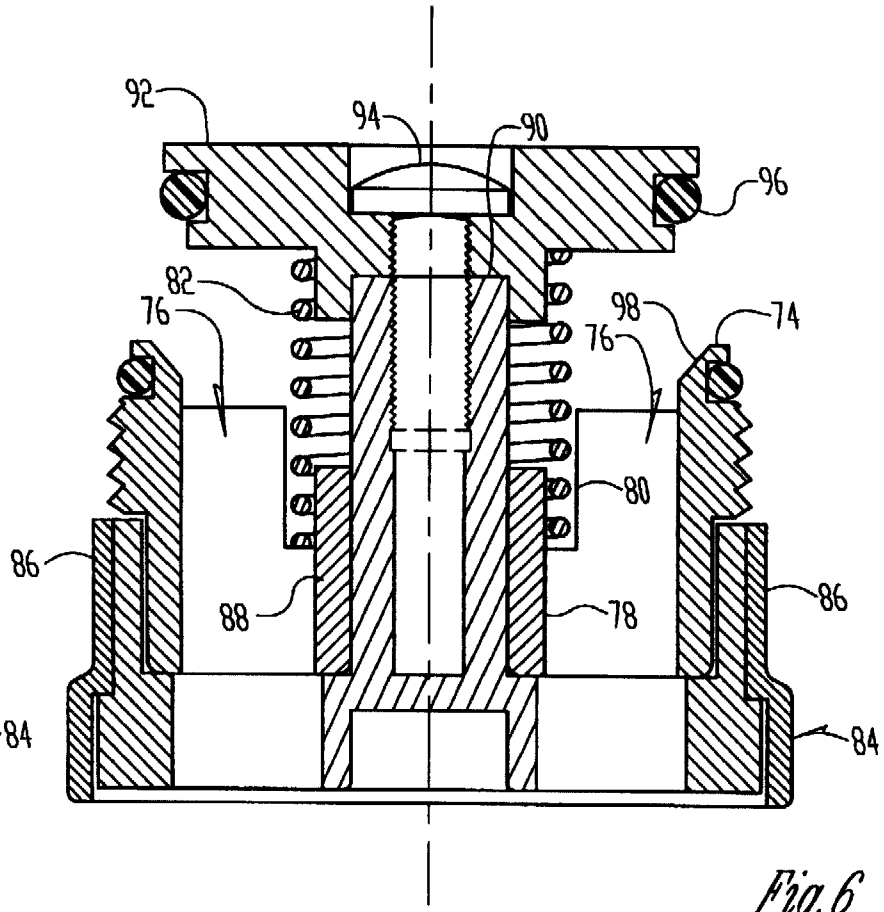
FIG. 6 is an enlarged scale sectional view of the flow diverter element in an open condition.
Figure 7:
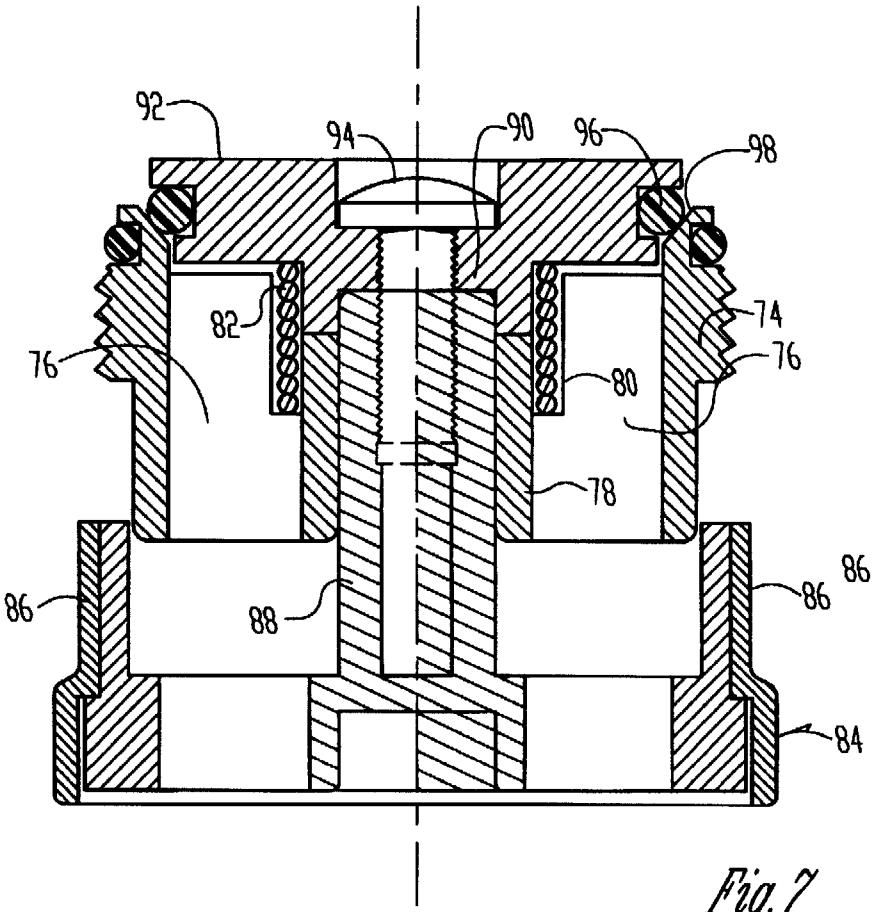
FIG. 7 is a view similar to that of FIG. 6 wherein the flow diverter element is shown in a closed condition.

FIG. 6 shows the flow diverter element 70 in an open condition. When it is desired to close the flow diverter element 70, the slide control element 84 is slidably moved downwardly from the position shown in FIG. 6 to the position shown in FIG. 7. This pulls the seal cap 92 from the position shown in FIG. 6 to the seated position shown in FIG. 7 which permits the seal cap 92 to close the flow way 76 in the hollow fitting 74. The spring 82 is compressed as the flow diverter element 70 is moved to the closed position in FIG. 7. Conventionally, the flow of fluid under pressure with the flow diverter element 70 in its closed position will maintain the closed position of the diverter element. Thus, when fluid under pressure is flowing in the direction of the arrows shown in FIG. 5, the flow diverter element will remain in its closed position and will stay closed until such time as the flow of fluid under pressure is withdrawn. FIGS. 4 and 5 show the flow diverter element 70 in the positions of FIGS. 6 and 7, respectively. The flow diverter element is normally in the open position shown in FIGS. 4 and 6 by reason of the action of spring 82.

The numeral 100 designates the ground surface around the hydrant, and the numeral 102 designates the frost line which is typically above the control valve 28.

The hydrant of U.S. Pat. No. 5,246,028 experienced two significant problems. First, when the hydrant thereof was operated, the supply water flowing through the venturi assembly increased in velocity and caused a negative pressure which permitted the water in the reservoir to be siphoned therefrom into the supply water conduit. However, if a hose or backflow preventer, or any other nozzle attachment that decreased the velocity of the supply water running through the venturi assembly was added, the siphoning action would not function and the residual water would not be siphoned from the reservoir. The second problem was that the siphoning action, even when operative, would not completely empty the reservoir, because water below the top of the venturi check valve could not be siphoned through the check valve. There was no way to correct the latter problem. The only way to correct the problem of the siphoning not taking place was to remove the hose, or backflow preventer, or the like so that full flow of conditions would exist wherein the siphoning of the fluid reservoir would then take place.

The present invention solves those two problems of the prior art. First, the tube 48 allows water below the top of the venturi check valve 38 to be evacuated when siphoning is taking place since the lower end of the tube 48 extends substantially to the bottom of the reservoir 13.

More importantly, the hydrant of this invention, by means of the flow diverter element 70, allows full flow conditions to exist whether a hose or backflow preventer is attached to the hydrant.

In its typical operational mode, the flow diverter element 70 is in its open condition as shown in FIG. 4. When the handle 58 of the hydrant is actuated to cause rod 54 to open control valve 28, fluid will flow from the hydrant through the open flow diverter element 70 (FIG. 4). This will permit the hydrant to evacuate any residual water from the fluid reservoir 13 in the manner described above.

However, if a hose or a backflow preventer is attached to the nozzle discharge end 64 of the hydrant, the person operating the hydrant will manually close the flow diverter element 70 by moving it from the position shown in FIG. 4 to the position shown in FIG. 5. (Or the position shown in FIG. 6 to the position of FIG. 7.) This will cause the water flowing through the hydrant to divert out through the backflow preventer 66. When that operation is completed, the handle 58 is closed so that the control valve 28 is also closed. Any water in pipe 26A above control valve 28 will flow through drain hole 30 into reservoir 13. The closing of the hydrant will permit the spring 82 to move the flow diverter element 70 back to its open position shown in FIG. 4. The hydrant is then operated again for a short time which will permit water to flow out of the flow diverter element 70 which will purge the residual water in the reservoir. This typically takes approximately 30 seconds. The hydrant is then closed and the residual water in the reservoir is purged, all without having had to remove the backflow preventer or hose from the hydrant. Also, a further important function of the flow diverter element 70 is that, when in its normally open position, it vents the fluid reservoir 13 regardless of whether a hose or backflow preventer is attached to the hydrant. This insures that fluid in pipe 26A above control valve 28 will drain through hole 30 into reservoir 13 below frost line 102 to avoid freezing.

Accordingly, it is seen that the device of this invention will achieve at least its stated objectives.

What is claimed is:

1. A sanitary yard hydrant, comprising, an elongated vertical hollow tube having upper and lower ends and an internal fluid reservoir, a vertically disposed first pipe extending from within said reservoir upward through the upper end of said tube, and having upper and lower ends, a fluid control valve mounted at the lower end of said pipe and movable between open and closed positions, a vertically disposed second pipe extending downwardly from said valve and adapted to be connected to a source of fluid under pressure, an operating rod extending upwardly from said control valve through said first pipe, a fluid discharge means on the upper end of said first pipe and in communication with the interior of said first pipe, a hydrant handle connected to the upper end of said first pipe and to said operating rod and being movable between opposite positions to cause said control valve to be moved between open and closed positions to control the flow of fluid from said second pipe into said first pipe, said control valve having a drain opening to permit flow of fluid from said first pipe into said reservoir when said control valve is closed, a venturi valve connected to said second pipe and in communication with said reservoir to permit fluid in said reservoir to flow therethrough into said second pipe when fluid under pressure is flowing upwardly through said second pipe, said control valve, and said first pipe, and to close to prevent the flow of fluid therethrough from said second pipe into said reservoir when said control valve is closed, said fluid discharge means including a fluid conduit having a discharge end, and a fluid backflow preventer on said discharge end, and a normally open fluid diverter discharge element in said fluid conduit upstream from said discharge end and said backflow preventer to permit fluid flowing through said fluid conduit to exit said fluid conduit through said fluid diverter discharge element and not through backflow preventer and being in communication with said first pipe to vent said first pipe so that any fluid in said first pipe can drain into said reservoir when said control valve is closed.

2. The hydrant of claim 1 wherein said fluid diverter discharge element includes a spring loaded valve element biased in a normally open position which can be manually moved to a closed position, whereupon fluid under pressure flowing through said fluid conduit and through said backflow preventer will yieldingly hold said valve element in a closed position.

3. The hydrant of claim 1 wherein said venturi valve is in communication with the lower end of said reservoir to permit substantially all of the fluid in said reservoir to be vacated therefrom through said venturi valve into said second pipe upon continued flow of fluid under pressure upwardly through said second pipe.

4. The hydrant of claim 3 wherein said reservoir has a substantially horizontal bottom, a tube extends from said venturi valve and extends to the bottom of said reservoir where it terminates in a fluid inlet port to insure that substantially all fluid in said reservoir above said bottom can be vacated from said reservoir upon continued flow of fluid under pressure upwardly through said second pipe.

5. A sanitary yard hydrant, comprising, a vertically disposed tube having an internal fluid reservoir, a pipe extending through said reservoir and having upper and lower ends, with said lower end adapted for connection to a source of fluid under pressure, a control valve in said pipe movable between open and closed positions to control the flow of fluid under pressure through said pipe, a valve control lever on an upper end of said pipe and operatively connected to said control valve, a drain opening in said control valve to permit fluid in said pipe above said control valve to drain into said reservoir when said control valve is closed, a venturi check valve connected to the lower end of said pipe and being in communication with the lower end of said reservoir to permit fluid in said reservoir to flow into said pipe when fluid under pressure is flowing upwardly through said pipe, a fluid discharge conduit on the upper end of said pipe and having a discharge end, and a fluid backflow preventer on said discharge end, and a normally open fluid diverter discharge element in said fluid conduit upstream from said discharge end and said backflow preventer to permit fluid flowing through said fluid conduit to exit said fluid conduit through said fluid diverter discharge element and not through backflow preventer and being in communication with said first pipe to vent said first pipe so that any fluid in said first pipe can drain into said reservoir when said control valve is closed.

6. The hydrant of claim 5 wherein said fluid diverter discharge means includes a spring loaded valve element biased in a normally open position which can be manually moved to a closed position, whereupon fluid under pressure flowing through said fluid conduit and through said backflow preventer will yieldingly hold said valve element in a closed position.

7. The hydrant of claim 5 wherein said venturi valve is in communication with the lower end of said reservoir to permit all of the fluid in said reservoir to be vacated therefrom through said venturi valve into said second pipe upon continued flow of fluid under pressure upwardly through said second pipe.

8. The hydrant of claim 7 wherein said reservoir has a substantially horizontal bottom, a tube extends from said venturi valve and extends to the bottom of said reservoir where it terminates in a fluid inlet port to insure that all fluid in said reservoir above said bottom can be vacated from said reservoir upon continued flow of fluid under pressure upwardly through said second pipe.

9. A sanitary yard hydrant, comprising, an elongated pipe having upper and lower ends, said lower end being adapted for connection to a source of fluid under pressure, a control valve connected to said pipe to control the flow of fluid in said pipe and being operable between open and closed positions, a drain port associated with said control valve for allowing fluid in said pipe above said control valve to drain downwardly and outwardly from said pipe, a fluid discharge conduit on the upper end of said pipe and having a discharge end, and a fluid backflow preventer on said discharge end, and a normally open fluid diverter discharge element in said fluid conduit upstream from said discharge end and said backflow preventer to permit fluid flowing through said fluid conduit to exit said fluid conduit through said fluid diverter discharge element and not through said backflow preventer, and being in communication with said first elongated pipe to vent said elongated pipe so that any fluid in said elongated pipe can drain outwardly therefrom when said control valve is closed.

10. The hydrant of claim 9 wherein said fluid diverter discharge means includes a spring loaded valve element biased in a normally open position which can be manually moved to a closed position, whereupon fluid under pressure flowing through said fluid conduit and through said backflow preventer will yieldingly hold said valve element in a closed position.

11. The structure of claim 1 wherein said normally open fluid diverter discharge element vents said pipe above said control valve to permit fluid in said pipe above and control valve to enter said reservoir when said control valve is enclosed.

12. The structure of claim 5 wherein said normally open fluid diverter discharge element vents said pipe above said control valve to permit fluid in said pipe above and control valve to enter said reservoir when said control valve is enclosed.

13. The structure of claim 9 wherein said normally open fluid diverter discharge element vents said pipe above said control valve to permit fluid in said pipe above and control valve to drain from said pipe when said control valve is closed.

* * * * *